US008833735B2

(12) United States Patent
Uhlmann

(10) Patent No.: US 8,833,735 B2
(45) Date of Patent: Sep. 16, 2014

(54) FUEL INJECTION VALVE FOR INTERNAL COMBUSTION ENGINES

(75) Inventor: Dietmar Uhlmann, Korb (DE)

(73) Assignee: Robert Bosch GmbH, Stuttgart (DE)

( * ) Notice: Subject to any disclaimer, the term of this patent is extended or adjusted under 35 U.S.C. 154(b) by 205 days.

(21) Appl. No.: 13/490,034

(22) Filed: Jun. 6, 2012

(65) Prior Publication Data

US 2012/0305823 A1 Dec. 6, 2012

(30) Foreign Application Priority Data

Jun. 6, 2011 (DE) ..... 10 2011 076 957

(51) Int. Cl.
*F16K 27/00* (2006.01)
*F02M 61/16* (2006.01)

(52) U.S. Cl.
CPC ..... *F02M 61/168* (2013.01); *F02M 2200/803* (2013.01); *F02M 2200/8076* (2013.01)
USPC ..... 251/366; 239/533.2; 239/585.5; 239/600

(58) Field of Classification Search
USPC ..... 239/5, 88–92, 96, 533.2–533.12, 239/585.1–585.5, 600; 251/366
See application file for complete search history.

(56) References Cited

U.S. PATENT DOCUMENTS 6,666,390 B2 * 12/2003 Itou ..... 239/600
6,712,295 B2 * 3/2004 Frank ..... 239/533.2
6,719,221 B2 * 4/2004 Klugl et al. ..... 239/533.3
6,929,247 B2 8/2005 Kienzler et al.
7,014,130 B2 3/2006 Maier et al.
2004/0046059 A1 * 3/2004 Kienzler et al. ..... 239/533.2
2006/0151637 A1 * 7/2006 Schneider et al. ..... 239/533.2
2011/0088660 A1 4/2011 Gruenberger

FOREIGN PATENT DOCUMENTS

DE 102005020833 11/2006
EP 1775460 4/2007

OTHER PUBLICATIONS

Jayendran, A., "Englisch für Maschinenbauer: Lehr- und Arbeitsbuch," Springer DE, 2007, pp. 72-73.

* cited by examiner

*Primary Examiner* — John K Fristoe, Jr.
*Assistant Examiner* — Ian Paquette
(74) *Attorney, Agent, or Firm* — Michael Best & Friedrich LLP

(57) ABSTRACT

A fuel injection valve (100) for internal combustion engines, having a housing (10) in which a nozzle body (11) is at least indirectly axially clamped against a holding body (15) by means of a clamping nut (18), wherein the clamping nut (18) radially surrounds the nozzle body (11), and wherein a threaded connection (20) between the holding body (15) and the clamping nut (18) is formed between the clamping nut (18) and the holding body (15) in a region which is axially spaced apart from the nozzle body (11). The threaded connection (20) comprises at least two toothing regions (21, 22) which have different threaded dimensions and are arranged axially one behind the other in the longitudinal direction of the housing (10).

19 Claims, 4 Drawing Sheets

FUEL INJECTION VALVE FOR INTERNAL COMBUSTION ENGINES

BACKGROUND OF THE INVENTION

The invention relates to a fuel injection valve for internal combustion engines.

A fuel injection valve of this type is known from DE 10 2008 001 330 A1 by the applicant. Said fuel injection valve comprises essentially, on the side facing the combustion chamber of the internal combustion engine, a nozzle body which is accommodated in a housing and in which a nozzle needle is guided in such a way that it can move up and down. The nozzle needle is at least indirectly axially clamped, together with the nozzle body by means of a clamping nut, against a holding body arranged in the housing. The clamping nut has an inner thread as part of a threaded connection, which inner thread interacts with a corresponding external thread on the holding body and also forms, in particular, a seal of the housing for fuel which is arranged in the region of the nozzle body and which is under relatively high pressure; a pressure of more than 1500 bar is meant here; during operation of the fuel injection valve.

The trend in fuel injection technology is for increasingly high fuel injection pressures in order to achieve better efficiency levels and/or a lower consumption. As a result, increasingly stringent requirements are made for the seal of the housing, in the present case in particular in the region of the threaded connection.

SUMMARY OF THE INVENTION

Taking the illustrated prior art as a starting point, the invention is based on the object of developing a fuel injection valve for internal combustion engines in such a way that the threaded connection thereof connects the clamping nut to the holding nut and forms a seal of the housing toward the outside, in such a way that said seal is particularly tight, in particular in the case of relatively high fuel pressures.

This object is achieved in a fuel injection valve for internal combustion engines wherein the threaded connection (20) comprises at least two toothing regions (21, 22) which have different threaded dimensions and are arranged axially one behind the other in the longitudinal direction of the housing. The invention is based here on the idea of developing the threaded connection in such a way that there are at least two toothing regions which have different threaded dimensions and adjoin one another axially one behind the other in the longitudinal direction of the housing. This makes it possible to optimize the respective toothing regions with respect to their specific properties and/or functions. In particular this permits, for example, a first toothing region to be embodied in an optimum way in terms of its seal, while a second toothing region is optimized in terms of the relatively simple mounting of the clamping nut.

In a structurally preferred embodiment it is proposed that a thread-free intermediate section is formed between the two toothing regions. This thread-free intermediate section permits, in particular, the two toothing regions on the clamping nut and respectively on the holding body to be implemented relatively easily in terms of fabrication technology.

An embodiment in which the threaded dimensions of the two toothing regions differ in the thread diameters and the number of teeth, and in that the lead of the toothing regions are equal, is particularly preferred. Embodying the threaded dimensions in such a different way both provides the desired seal while at the same time permitting easy mounting of the clamping nut on the holding body.

In a particularly preferred structural embodiment it is proposed that the axial length of the thread-free intermediate region corresponds to the axial length of a first toothing region on the clamping nut, which toothing region is arranged on the side of the clamping nut facing the holding body. Such an embodiment always permits the clamping nut to be guided and/or to engage on the holding body in the axial direction when the clamping nut is screwed onto the holding body.

In order to achieve the desired improved seal of the threaded connection, it is proposed that the second toothing region has, on the side of the clamping nut facing the nozzle body, the smaller thread diameter and twice the number of teeth compared to the first toothing region. As a result, according to a further refinement of the invention, it is made particularly easily possible for the wall thickness of the clamping nut to be larger in the second toothing region than in the first toothing region. In this context, the increased wall thickness of the clamping nut can particularly well absorb the pressure stresses which occur, and widening of the clamping nut compared to the prior art owing to the hydraulic pressure is reduced, which improves the seal of the second toothing region.

BRIEF DESCRIPTION OF THE DRAWINGS

Further advantages, features and details of the invention emerge from the following description of preferred exemplary embodiments and on the basis of the drawing, in which.

DETAILED DESCRIPTION

Figure 1:
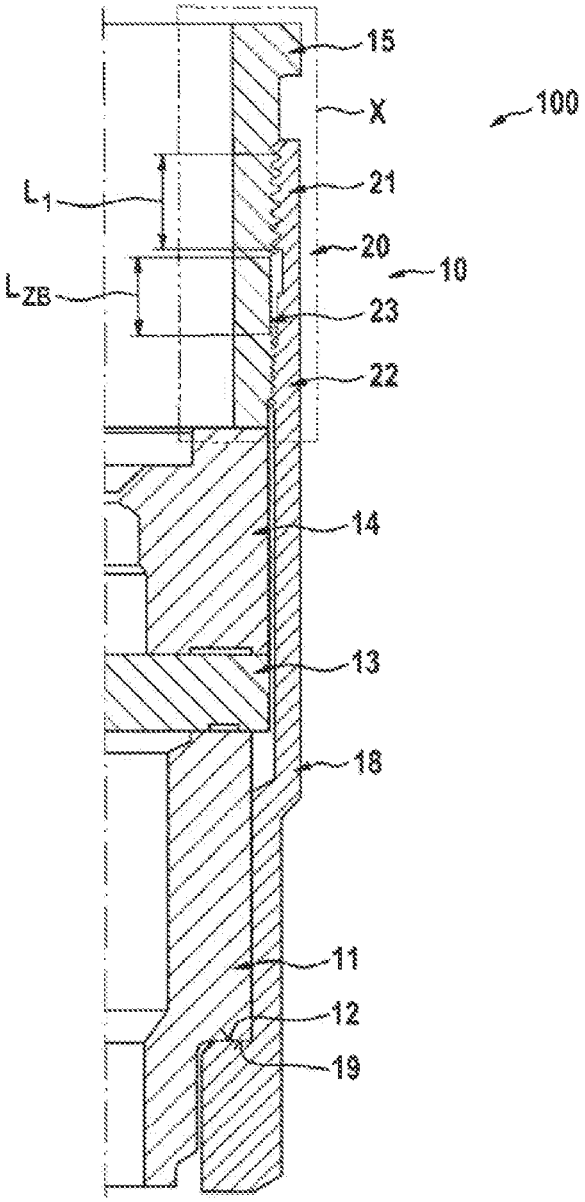
FIG. 1 shows a detail of a fuel injection valve according to the invention for internal combustion engines in a partial longitudinal section.

FIG. 1 shows an illustrated detail of a fuel injection valve 100 according to the invention such as serves for injecting fuel into a combustion chamber of an internal combustion engine (not illustrated), in particular an auto-ignition internal combustion engine. In particular, the fuel injection valve 100 is a component of what is referred to as a common rail injection system in which each cylinder of the internal combustion engine is assigned a separate fuel injection valve 100 which is supplied with fuel by a common rail. In this context, the injection pressure of the fuel injection valve 100 preferably comprises more than 1500 bar.

The fuel injection valve 100 has a housing 10, of which only certain areas are illustrated and in which, inter alia, an injection valve element (not illustrated), in particular in the form of a nozzle needle, is arranged in such a way that it can move up and down. Arranged within the housing 10 is a nozzle body 11 which simultaneously forms the end of the fuel injection valve 100 facing the combustion chamber of the internal combustion engine. The nozzle body 11 has, on its outer circumference, a step 12. In the illustration in FIG. 1 above the nozzle body 11, a throttle plate 13 is arranged, and on the side of the throttle plate 13 facing away from the nozzle body 11 a valve plate 14 is arranged. On the side of the valve plate 14 lying opposite the throttle plate 13, there is an adjoining holding body 15 of the housing 10, against which holding body 15 the nozzle body 11, throttle plate 13 and the valve plate 14 are axially clamped. The axial clamping of the aforementioned components of the fuel injection valve 100 is carried out by means of a clamping nut 18 which has, on its inner wall at its end facing the nozzle body 11, a diameter step 19 which bears flush against the step 12 of the nozzle body 11.

With respect to the rest of the design of a fuel injection valve 100 and the method of functioning thereof, reference is made to DE 10 2008 001 330 A1 by the applicant, which document is to be considered in this respect to be a component of this application.

In the region of the detail X in FIG. 1, a threaded connection 20 is formed between the holding body 15 and the clamping nut 18. The threaded connection 20 has a first toothing region 21 on the side facing away from the nozzle body 11, and a second toothing region 22 on the side facing the nozzle body 11. In each case, as can be seen, in particular, from FIG. 3, a toothing-free intermediate region 23 is provided between the first toothing region 21 and the second toothing region 22, both on the nozzle body 11 and on the holding body 15. The intermediate region 23 is formed in the region of the holding body 15 as a cylindrical section 17 with an external diameter which is the same all the way through. In contrast, in the region of the clamping nut 18, two sections 24, 25 are formed in the vicinity of the intermediate region 23, which sections 24, 25 are each of cylindrical design, wherein the section 24 facing the first toothing region 21 has a larger internal diameter than the section 25 facing the second toothing region 22. The two sections 24, 25 are preferably embodied with approximately the same length, for example each with approximately 2 mm.

While the first toothing region 21 in the region of the clamping nut 18 is arranged at the end of the clamping nut 18 facing away from the nozzle body 11, the second toothing region 22 is located in the region of the holding body 15, on the side facing the valve plate 14 near to the lower end face 26 of the holding body 15.

The first toothing region 21, which is embodied as an external thread on the holding body 15, has a thread with the dimensions M17×0.75 mm, while the second toothing region 22 on the holding body 15 is embodied as an external thread with the dimensions of M16×0.75 mm. Furthermore, the first toothing region 21, which is embodied as an internal thread, on the clamping nut 18 has half the number of teeth of the second toothing region 22 on the clamping nut 18.

Figure 3:
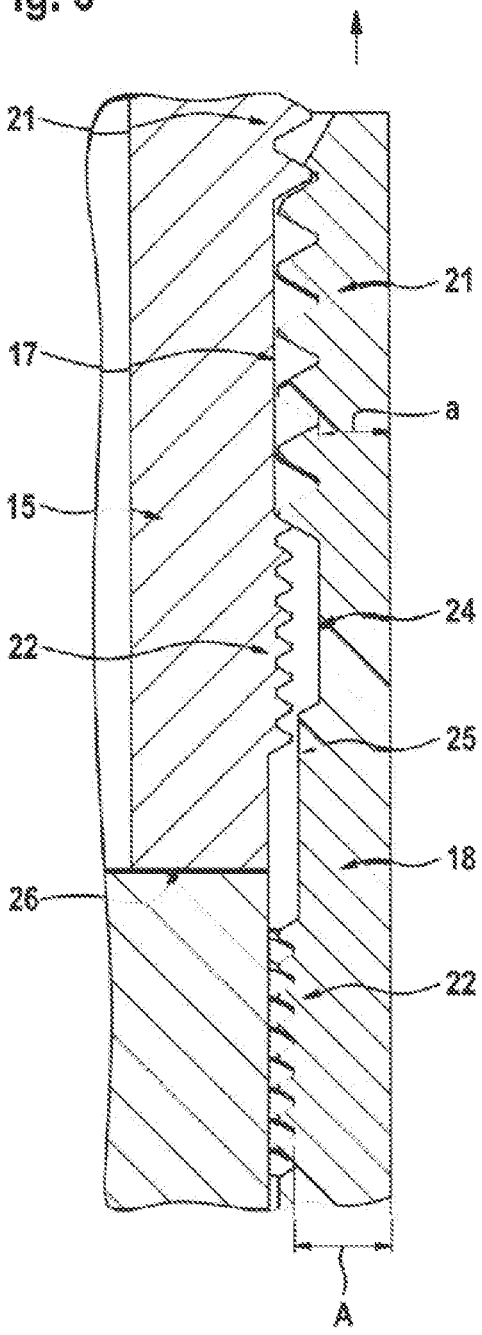

As is apparent, in particular, from FIG. 3, due to the different dimensioning of the threads of the two thread sections 21, 22 with a continuously cylindrical external contour of the clamping nut 18 in the region of the threaded connection 20 in the vicinity of the second toothing region 22 of the clamping nut 18 from the tooth base of the toothing a wall thickness A of the clamping nut 18 is formed which is larger than the wall thickness a of the clamping nut 18 in the region of the first toothing region 21. As is also apparent from FIG. 1, the length $L_1$ of the first toothing region 21 on the clamping nut 18 is preferably of the same length as the length $L_{ZB}$ of the thread-free intermediate region 23.

Figure 2:
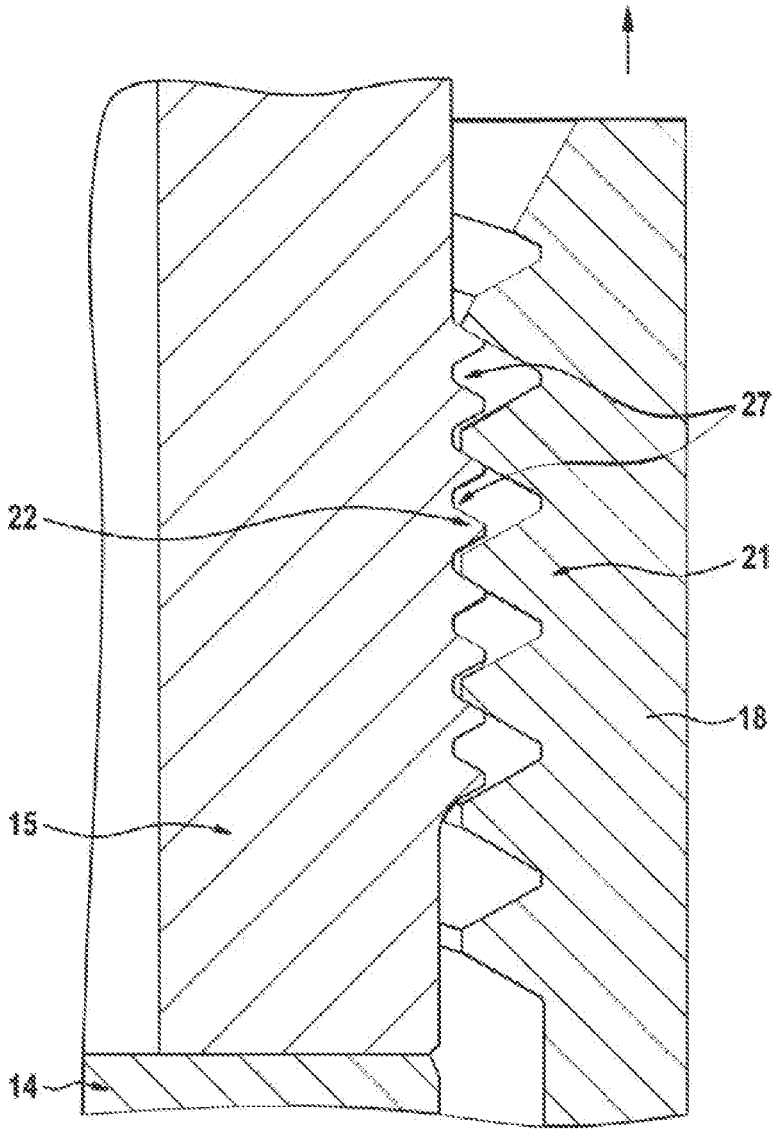
FIGS. 2 to 4 show the detail X according to FIG. 1 in the screwing region of a clamping nut with a holding body during various phases of the screwing of the clamping nut to the holding body, in a respectively enlarged view.
Figure 4:
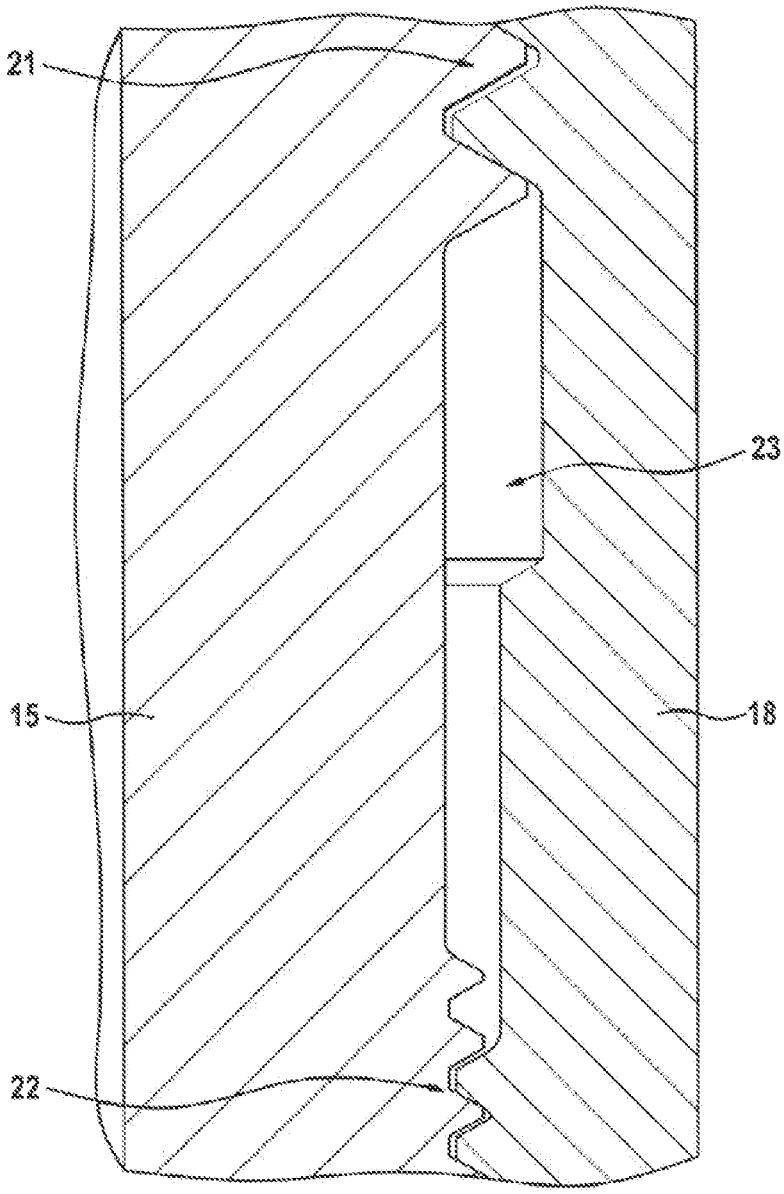

FIGS. 2 to 4 illustrate different phases of the assembly process of the clamping nut 18 on the holding body 15. FIG. 2 illustrates the state in which the first toothing region 21 of the clamping nut 18 is located in the vicinity of the second toothing region 22 of the holding body 15. In this context, it is apparent, in particular, that since the number of teeth in the first toothing region 21 on the clamping nut 18 is halved, a gap 27 is respectively formed between the teeth of the second toothing region 22 of the holding body 15.

FIG. 3 illustrates the state in which the first toothing region 21 of the clamping nut 18 moves in the region of the first toothing region 21 of the holding body 15. The significant feature here is that at the start of the engagement of the thread turn of the first toothing region 21 of the clamping nut 18 in the first toothing region of the holding body 15, the exit of the turn of the first toothing region 21 of the clamping nut 18 is still in bearing contact with the second toothing region 22 of the holding body 15. As a result, the first toothing region 21 of the clamping nut 18 is always in engagement with one of the two toothing regions 21, 22 of the holding body 15, with the result that the clamping nut 18 is prevented from slipping through or dropping through during the process of mounting on the holding body 15.

The combination of FIGS. 1 and 4 illustrates the final state of the mounting of the clamping nut 18 on the holding body 15, in which the diameter stage 19 of the clamping nut 18 is in bearing contact with the step 12 of the nozzle body 11, and therefore axially clamps the nozzle body 11 against the holding body 15 via the valve plate 14 and the holding body 15.

The threaded connection 20 which is described in this fashion on the fuel injection valve 100 can be modified in a variety of ways without departing from the inventive idea.

The invention claimed is:

1. A fuel injection valve (100) for internal combustion engines, comprising a housing (10) in which a nozzle body (11) is at least indirectly axially clamped against a holding body (15) by means of a clamping nut (18), wherein the clamping nut (18) radially surrounds the nozzle body (11), and wherein a threaded connection (20) between the holding body (15) and the clamping nut (18) is formed between the clamping nut (18) and the holding body (15) in a region which is axially spaced apart from the nozzle body (11), characterized in that the threaded connection (20) comprises at least first and second toothing regions (21, 22) arranged axially one behind the other in a longitudinal direction of the housing (10), the first and second toothing regions (21, 22) having equal lead, but differing in thread diameter and number of teeth.

2. The fuel injection valve according to claim 1, characterized in that the first toothing region (21) on the holding body (15) is formed as an external thread with dimensions M17×0.75 mm, and the second toothing region (22) on the holding body (15) is formed as an external thread with dimensions M16×0.75 mm.

3. The fuel injection valve according to claim 1, characterized in that further components are arranged between the holding body (15) and the nozzle body (11) in the housing (10).

4. The fuel injection valve according to claim 1, characterized in that fuel located in a region of the nozzle body (11) has a pressure of more than 1500 bar.

5. The fuel injection valve according to claim 1, characterized in that a throttle plate (13) and a valve plate (14) are arranged between the holding body (15) and the nozzle body (11) in the housing (10).

6. The fuel injection valve according to claim 1, characterized in that a thread-free intermediate region (23) is formed between the two toothing regions (21, 22).

7. The fuel injection valve according to claim 6, characterized in that an axial length ($L_{ZB}$) of the thread-free intermediate region (23) on the holding body (15) corresponds to an axial length ($L_1$) of a first toothing region (21) on the clamping nut (18), which toothing region (21) is arranged on a side of the clamping nut (18) facing the holding body (15).

8. The fuel injection valve according to claim 7, characterized in that, in the screwed end position of the clamping nut (18), the second toothing region (22) on the holding body (15) is covered at least virtually completely by the second toothing region (22) of the clamping nut (18).

9. The fuel injection valve according to claim 7, characterized in that the second toothing region (22) has on the holding body (15) and on the clamping nut (18), on a side facing the nozzle body (11), a smaller thread diameter and twice the number of teeth compared to the first toothing region (21).

10. The fuel injection valve according to claim 9, characterized in that a wall thickness (A) of the clamping nut (18) in the second toothing region (22) is larger than a wall thickness (a) in the first toothing region (21).

11. A fuel injection valve (100) for internal combustion engines, comprising a housing (10) in which a nozzle body (11) is at least indirectly axially clamped against a holding body (15) by means of a clamping nut (18), wherein the clamping nut (18) radially surrounds the nozzle body (11), and wherein a threaded connection (20) between the holding body (15) and the clamping nut (18) is formed between the clamping nut (18) and the holding body (15) in a region which is axially spaced apart from the nozzle body (11), characterized in that the threaded connection (20) comprises at least first and second toothing regions (21, 22) which have different threaded dimensions and are arranged axially one behind the other in a longitudinal direction of the housing (10), further characterized in that a thread-free intermediate region (23) is formed between the two toothing regions (21, 22), and further characterized in that an axial length ($L_{ZB}$) of the thread-free intermediate region (23) on the holding body (15) corresponds to an axial length ($L_1$) of a first toothing region (21) on the clamping nut (18), which toothing region (21) is arranged on a side of the clamping nut (18) facing the holding body (15).

12. The fuel injection valve according to claim 11, characterized in that, in the screwed end position of the clamping nut (18), the second toothing region (22) on the holding body (15) is covered at least virtually completely by the second toothing region (22) of the clamping nut (18).

13. The fuel injection valve according to claim 11, characterized in that further components are arranged between the holding body (15) and the nozzle body (11) in the housing (10).

14. The fuel injection valve according to claim 11, characterized in that fuel located in a region of the nozzle body (11) has a pressure of more than 1500 bar.

15. The fuel injection valve according to claim 11, characterized in that a throttle plate (13) and a valve plate (14) are arranged between the holding body (15) and the nozzle body (11) in the housing (10).

16. The fuel injection valve according to claim 11, characterized in that the second toothing region (22) has on the holding body (15) and on the clamping nut (18), on a side facing the nozzle body (11), a smaller thread diameter and twice the number of teeth compared to the first toothing region (21).

17. The fuel injection valve according to claim 16, characterized in that a wall thickness (A) of the clamping nut (18) in the second toothing region (22) is larger than a wall thickness (a) in the first toothing region (21).

18. The fuel injection valve according to claim 11, characterized in that the first and second toothing regions (21, 22) having equal lead, but different thread diameter and number of teeth.

19. The fuel injection valve according to claim 18, characterized in that the first toothing region (21) on the holding body (15) is formed as an external thread with dimensions M17×0.75 mm, and the second toothing region (22) on the holding body (15) is formed as an external thread with dimensions M16×0.75 mm.

* * * * *